US005149411A

United States Patent [19]

Castle

[11] Patent Number: 5,149,411

[45] Date of Patent: Sep. 22, 1992

[54] TOXIC FUMES REMOVAL APPARATUS FOR PLATING TANK

[75] Inventor: Robert L. Castle, 305 Carlton Ave., Los Gatos, Calif. 95032

[73] Assignees: Robert L. Castle; Richard Castle; Charles D. Castle, all of Los Gatos, Calif.

[21] Appl. No.: 814,090

[22] Filed: Dec. 24, 1991

Related U.S. Application Data

[63] Continuation-in-part of Ser. No. 688,962, Apr. 22, 1991, abandoned.

[51] Int. Cl.[5] ..... C25B 15/08; C25D 21/02; C25D 21/04; C25D 21/06

[52] U.S. Cl. ..... 204/237; 204/238; 204/239; 204/277; 204/278; 204/DIG. 13

[58] Field of Search ..... 204/237-238, 204/278, DIG. 1, 277, 239, DIG. 13

[56] References Cited

U.S. PATENT DOCUMENTS

| | | | |
|---|---|---|---|
| 2,439,491 | 4/1948 | Schiffl | 204/277 |
| 3,839,180 | 10/1974 | Takaysu | 204/238 |
| 4,081,347 | 3/1978 | Becker | 204/278 X |
| 4,157,942 | 6/1979 | Tuznik et al. | 204/DIG. 13 X |
| 4,224,131 | 9/1980 | Acero et al. | 204/278 X |
| 4,378,285 | 3/1983 | Castellanos et al. | 204/278 X |
| 4,592,819 | 6/1986 | Suzuki et al. | 204/278 X |
| 4,933,061 | 6/1990 | Kulkarni et al. | 204/237 X |

*Primary Examiner*—Donald R. Valentine
*Attorney, Agent, or Firm*—Nathan N. Kallman

[57] ABSTRACT

A plating system includes a plating tank and a separation tank connected in a closed loop. Toxic bubbles or fumes are generated during plating which rise above the plating solution in the plating tank. Venturi and/or vortex scrubbers scrub the bubbles as the solution is drained from the plating tank to the separation tank. The toxic fumes are sucked into the primary scrubbing tube while the solution is drained from plating tank into the separation tank. The fine fumes are then forced through the secondary scrubber/filter. The solution once in the separation tank is then pumped back into the plating tank.

13 Claims, 7 Drawing Sheets

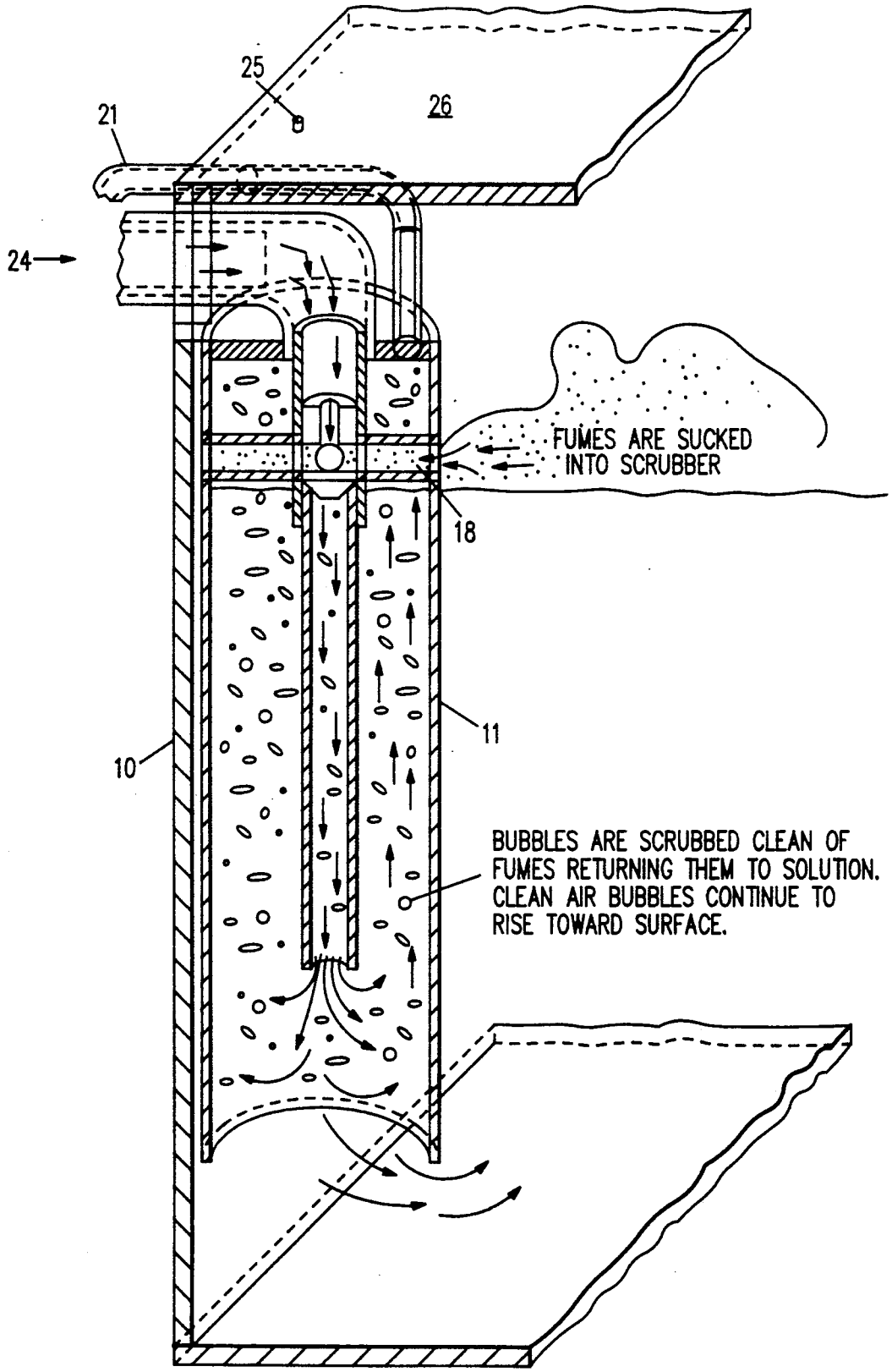
FIG. 2 CONTAINMENT CHAMBER

TOXIC FUMES REMOVAL APPARATUS FOR PLATING TANK

This application is a continuation-in part of copending U.S. patent application Ser. No. 07/688,962, now abandoned, filed Apr. 22, 1991.

FIELD OF THE INVENTION

This invention relates to a scrubbing device and in particular to a means and process for removing toxic fumes from a plating apparatus.

DESCRIPTION OF THE PRIOR ART

Electroplating is commonly used to coat an object with a thin layer of a metal, such as chromium, nickel, gold, copper or zinc, for example. Electroplating is accomplished by electrolytic deposition, wherein the article to be plated serves as the cathode. The cathodic object is placed in an electrolytic bath composed of a solution of the salt of the plating metal. The other terminal, the anode, may be made of the same metal or it may be a conductor that is chemically unaffected. A low voltage current is passed through the solution, which electrolyzes and plates the cathodic articles with the metal to a desired thickness. As the plating process proceeds, metal plating salt is added to maintain the strength of the solution, or the anode is renewed if the anode is composed of the plating metal.

During electroplating, metals and hydrogen are deposited on the cathode and dissolved in the anode, except when insoluble anodes are used in which case oxygen is liberated at the anode. The plating solution comprises $H_2O$ which comes in contact with the anode through which electrons flow. The electrons charge the hydrogen and cause the hydrogen atoms to separate from the oxygen atoms. Pockets of oxygen gas rise to the surface of the plating solution and when the pockets contact each other, larger pockets of oxygen are formed during the migration to the surface. When the oxygen pockets reach the surface, they rise from the surface in the form of bubbles. If distilled water only is used, the only gas inside the bubbles is oxygen.

The charged hydrogen, after separation from the oxygen, moves toward the cathode and comes in contact with particles of the metal salt giving them a positive charge. The particles that are charged continue to move towards the cathode. When the charged particles contact the cathode, extra electrons are removed from the hydrogen and pass into the cathode, and then migrate to ground. The particles adhere to the cathode thereby forming the thin plate. After losing the extra electrons, the hydrogen gas is free to rise to the surface forming bubbles in the same manner as the oxygen. The bubbles are now filled with hydrogen and the exterior surface of both the oxygen and hydrogen bubbles contain $H_2CrO_4$ (chromic acid) and $H_2SO_4$ (sulphuric acid), which are toxic materials that appear as toxic fumes. In conventional plating systems, blowers are used to expel the toxic fumes from the plating tank. The toxic fumes exit from the open top of the plating apparatus and are released to the environment, which apparently is a health hazard and highly undesirable.

Conventional plating systems employ scrubbers for purging toxic waste materials from the system. The prior art scrubbers are typically located external to the plating tank of the plating apparatus. The prior art scrubbers are very bulky requiring very large amounts of space and air, and are also unduly expensive. These types of scrubbers also use large amounts of water which in turn create toxic waste and require constant maintenance.

SUMMARY OF THE INVENTION

An object of this invention is to provide an apparatus and method for virtually eliminating the emission of toxic fumes that are generated during the plating process and for drastically reducing toxic waste.

Another object of the invention is to provide a plating apparatus which automatically cleans fumes without loss of plating solution.

Another object of this invention is to provide a significant reduction in cost and maintenance of an electroplating system.

According to this invention, an electroplating system comprises a plating tank containing a metal salt solution wherein articles are plated with a thin coat of a specified metal, and a fume separation tank coupled to the plating tank for receiving plating solution and dissipating toxic fumes formed during the electroplating process. Toxic fumes that are generated by the anode and cathode electrodes in the plating tank are contained under a lid and combined with air and drained with plating solution from the plating tank to the separation tank by Venturi and vortex action. A Venturi/vortex scrubber scrubs the fumes as the solution drains into the separation tank. As the fumes rise to the surface of the solution within the separation tank, the air and fumes are purged approximately 95% . The remaining fine fumes are forced through a secondary scrubber (filter/condenser) that collects toxic material to be returned to solution and virtually removes all remaining toxic fumes. In effect, the plating solution is circulated in a closed loop between the separation tank and the plating tank. In this manner, the plating solution is separated from the bubbles which carry the toxic materials so that the plating solution that is pumped from the separation tank to the plating tank is virtually cleansed of all toxic fumes, and the remaining toxic bubbles are forced through the secondary scrubber. The only gases released to the atmosphere are the harmless hydrogen and oxygen gases.

BRIEF DESCRIPTION OF THE DRAWINGS

The invention will be described in greater detail with reference to the drawings in which:

FIG. 2 is a side view of the containment chamber employed in the plating tank of FIG. 1;

Similar numerals refer to similar elements throughout the drawing.

DETAILED DESCRIPTION OF THE PREFERRED EMBODIMENT

Figure 1:
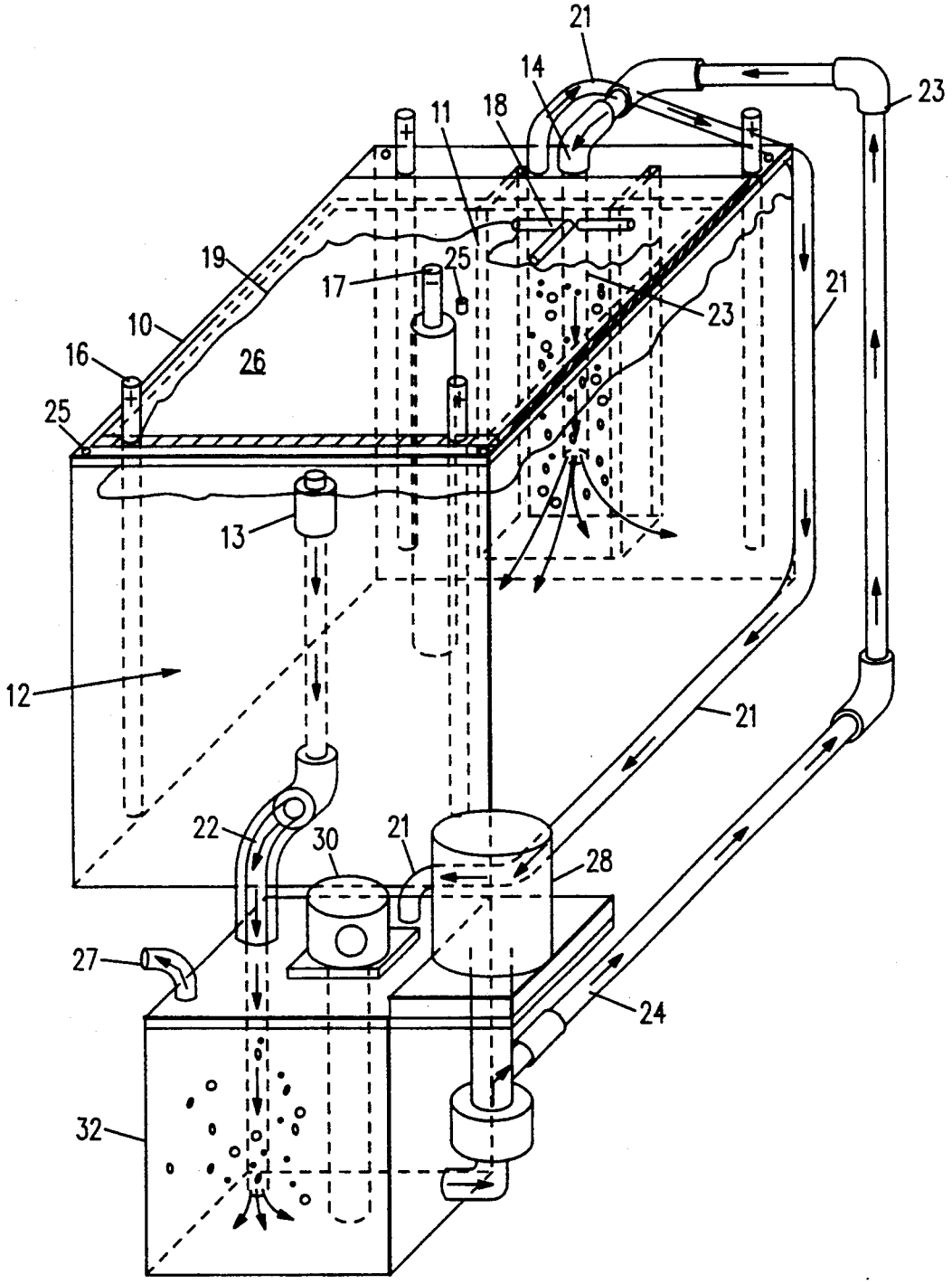
FIG. 1 is an isometric schematic view of the plating apparatus, including a plating tank with a lid and separation tank, in accordance with this invention.

With reference to FIG. 1, an electroplating apparatus comprises a plating tank 10 and an airtight separation tank 32. The plating tank 10 includes anode electrodes 16 and cathode electrodes 17 which are positioned in the plating tank for providing current of a predetermined magnitude through a plating solution 12 within the tank. The tank 10 is filled with a plating solution 12 to a given level. The solution 12 is formed of a metallic salt, such as a chromic compound, preferably mixed in distilled water and having a desired pH value. The spacing of the anode and cathode electrodes and the magnitude of the current, among other things, establish the throwing power and ability of the plating solution 12 to produce uniform deposits on irregular surfaces being plated.

A cover or lid 26 holds anodes and cathodes and is seated tightly on a lip formed on top of the plating tank 10. The lid 26 has air inlet apertures 25 at points adjacent to the anode and cathode electrodes to allow fresh air to enter the plating tank 10.

A containment chamber 11 is positioned at one end of the plating tank 10. The containment chamber 11 is formed as a bottomless box that is raised about ½ inch or more from the bottom of the plating tank. The containment chamber 11 encloses a Venturi tube 23 that is coupled to the holding tank 32 through pipes 33H and 33V which are joined by an elbow 34. The pipe 33H is connected to a pump 28 that pumps plating solution 12 from the holding tank 32 to the containment chamber 11 disposed in the plating tank 10. In this way, a closed loop for flow of the plating solution is formed by the pipes 33H, 33V and the Venturi tube 23 through which the plating solution is pumped by pump 28.

The containment chamber, shown in enlarged form in FIG. 2, captures bubbles which have been scrubbed by Venturi action in the Venturi tube 23. The air from the chamber 11 generated by rising bubbles from the Venturi 23 is vented through outlet pipe 21 to the holding tank 32. When the level of the plating solution in the plating tank falls below the top of the Venturi/vortex scrubber 13, the pump 28 acts to raise the level above the hole at the top of the scrubber 13. The pumping speed adjusts according to the level of the plating solution so that a substantially constant level is maintained.

The Venturi action is based on the principle that different flow velocities produce different amounts of suction. The constricted portion of the Venturi tube 23, shown in FIG. 3B, causes a suction effect which results in a scrubber action on the plating fluid and the bubbles that flow through the Venturi tube 23. Three intake tubes 18 are attached to the containment chamber to feed air and fumes to the Venturi tube 23. The intake tubes 18 intersect the Venturi tube 23 and the containment chamber 11 and are located closely above the solution level.

Figure 3A:
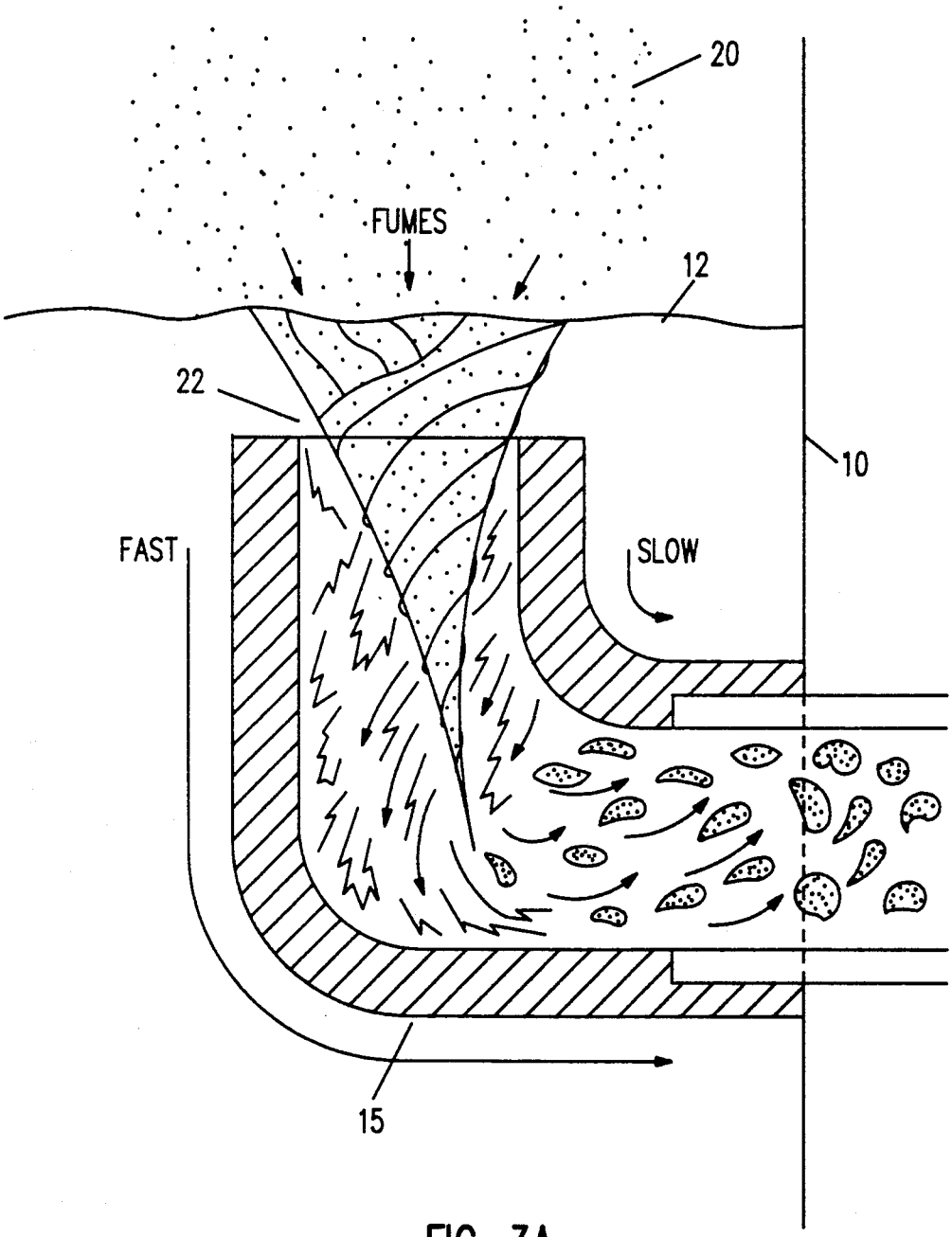
FIGS. 3A, 3B, 3C are enlarged representations, shown in part, of a vortex scrubber, Venturi scrubber and combination Venturi and vortex scrubber respectively, as used with the novel plating apparatus of this invention.
Figure 3B:
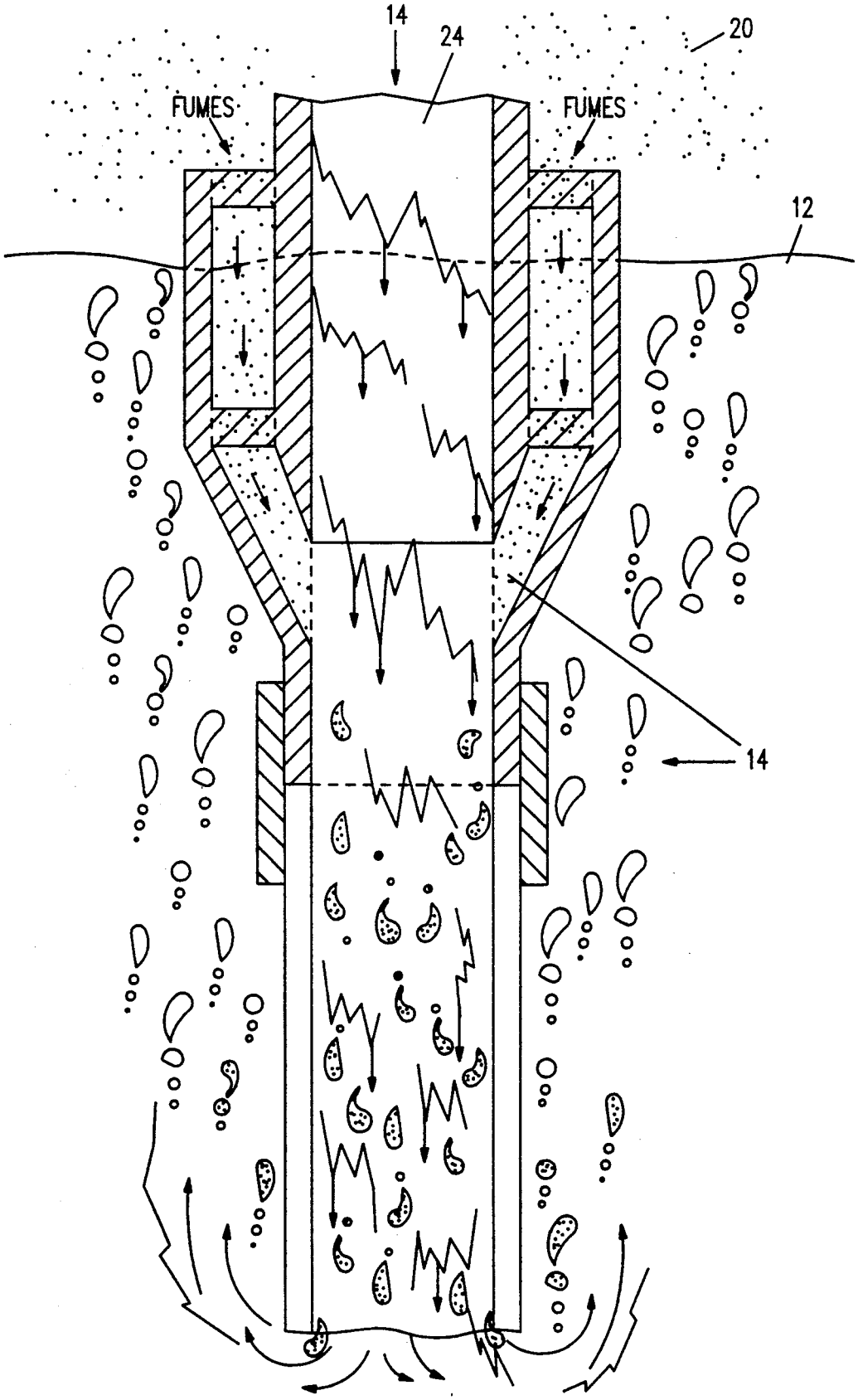
Figure 3C:
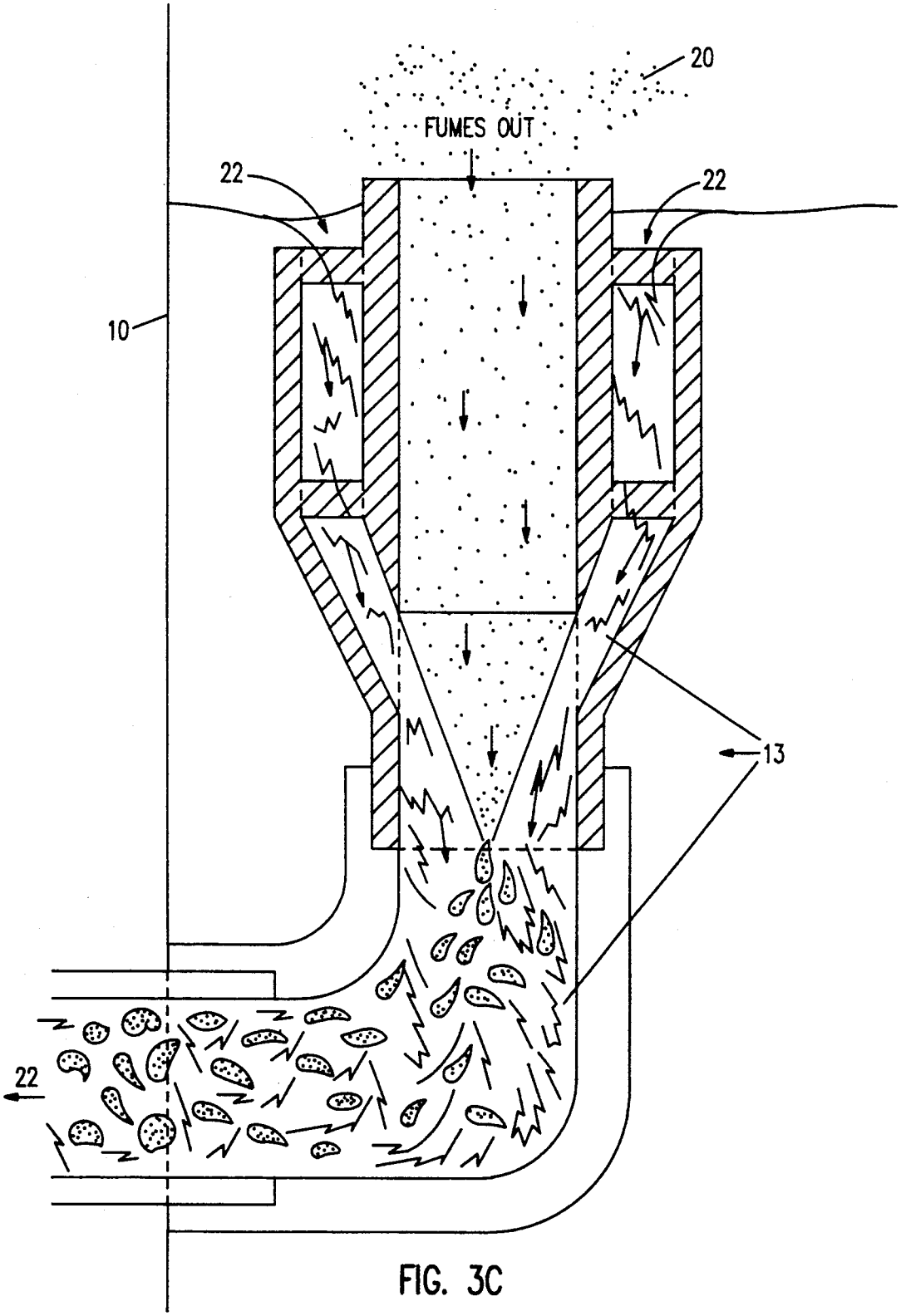

The Venturi scrubber 14, illustrated in FIG. 3B, sucks fumes into the solution 12 for scrubbing while the solution is fed into the plating tank. The Venturi tube 23 encloses the Venturi device or scrubber 14 and extends about 8 inches down into the plating solution.

In conjunction with the Venturi scrubber 14, a combination Venturi/vortex scrubber 13 sucks toxic fumes 20 from the air disposed above the surface 19 of the plating solution 12 into the solution for scrubbing, while the solution 12 is draining through conduit 22 into the holding tank 32. The vortex action sucks toxic fumes 20 into the plating solution 12 for scrubbing while the solution is drained from the plating tank into the holding tank. The circular vortex action combined with the suction generated by the Venturi action effectively scrubs the fumes in the bubbles with the plating solution to remove the toxic fumes. In effect, the apparatus uses the plating solution to scrub the fumes that are inside the air bubbles, including little bubbles inside big bubbles.

A heater 30 in the holding tank 32 heats the solution 12 to a desired temperature for the plating process. The holding tank 32 has a vent 27 protruding from its top surface for venting clean air to the surrounding area. The vent 27 can be connected to a meter to read if there are any fumes being vented, or to a heat exchanger that would convert some gases into liquid.

If the operator needs to open the lid 26 on the plating tank 10 while the plating is in progress, power to the anodes is shut off, which stops the generating of fumes. While the power is off, the Venturis are still running. Thus the plating tank is cleared of all fumes within seconds. At such time, it is safe to open the lid.

Figure 4:
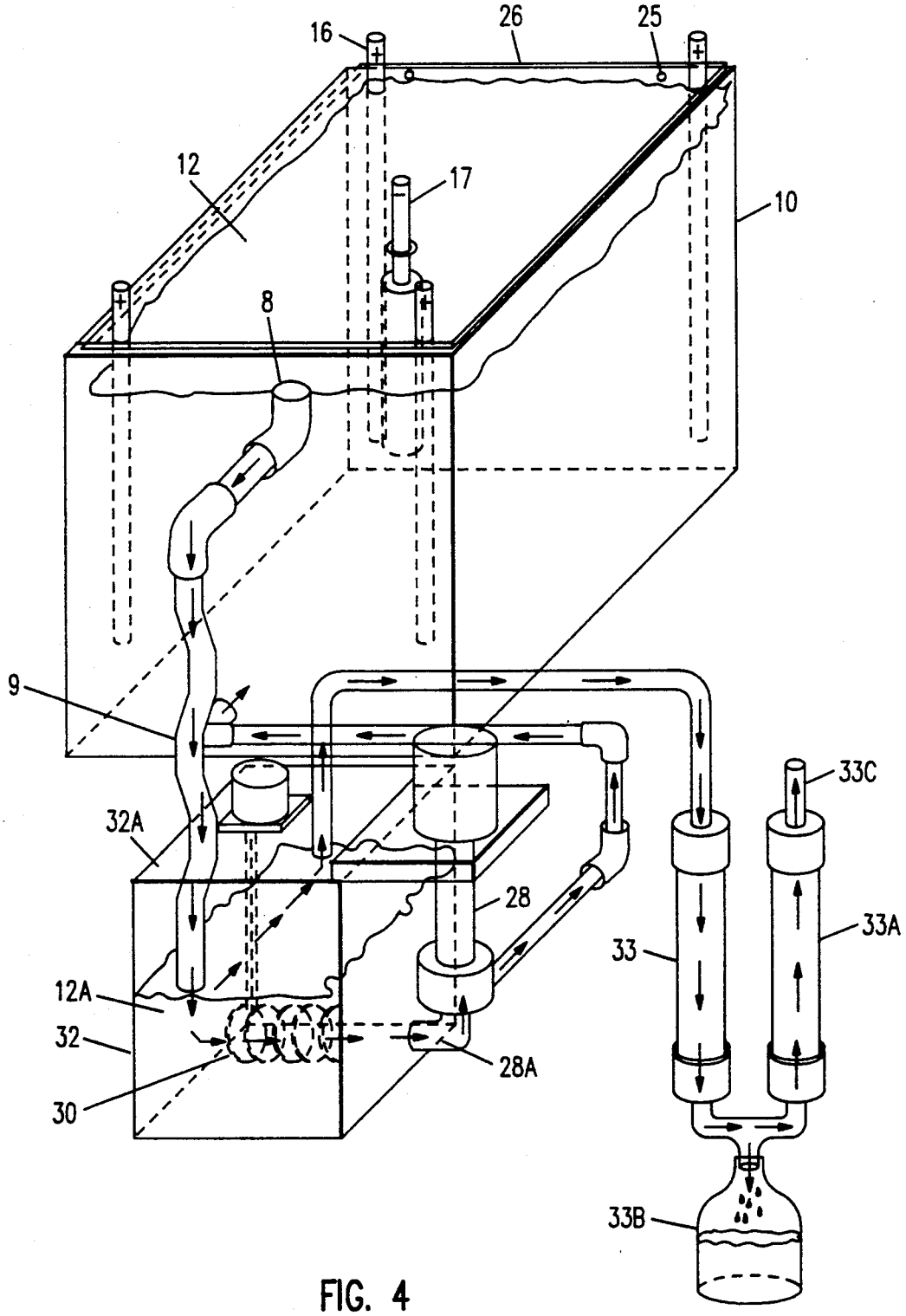
FIG. 4 is an isometric schematic view of another embodiment of the present invention.
Figure 5:
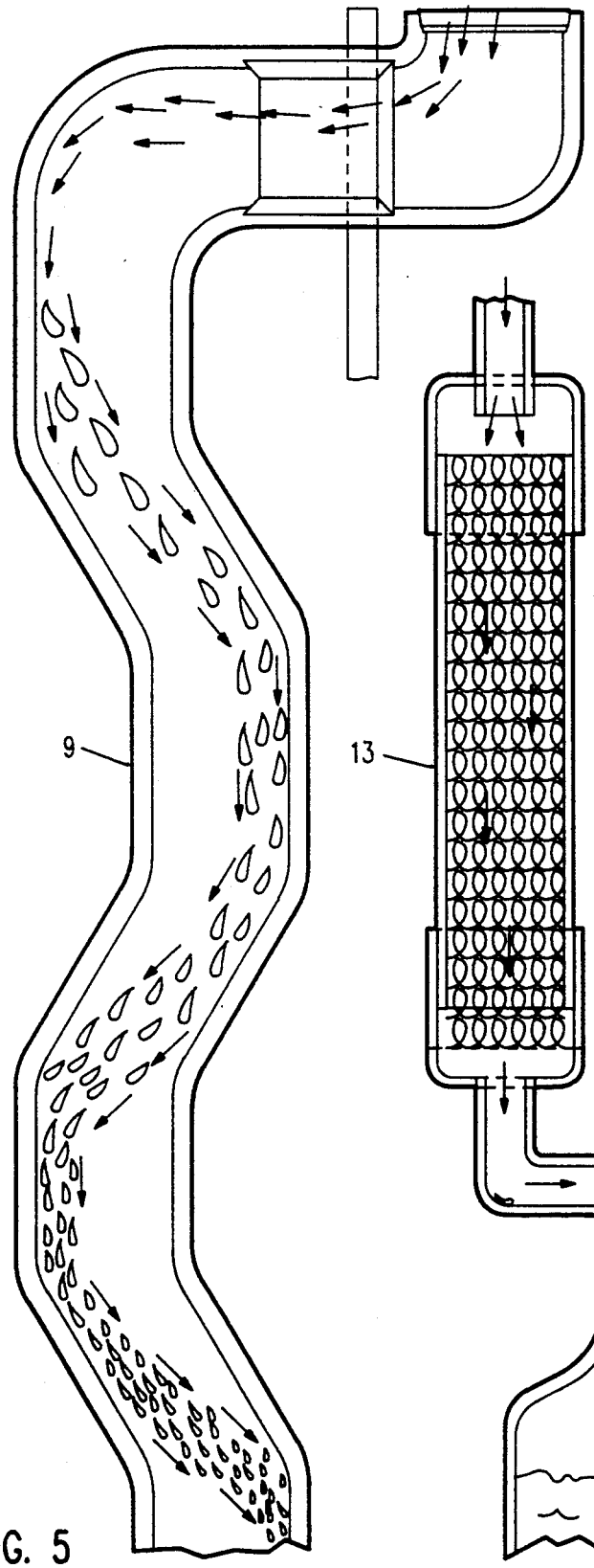
FIGS. 5 and 6 respectively are enlarged representations of a primary scrubbing tube and secondary scrubbing filter/condenser as used in the embodiment of FIG. 4.
Figure 6:
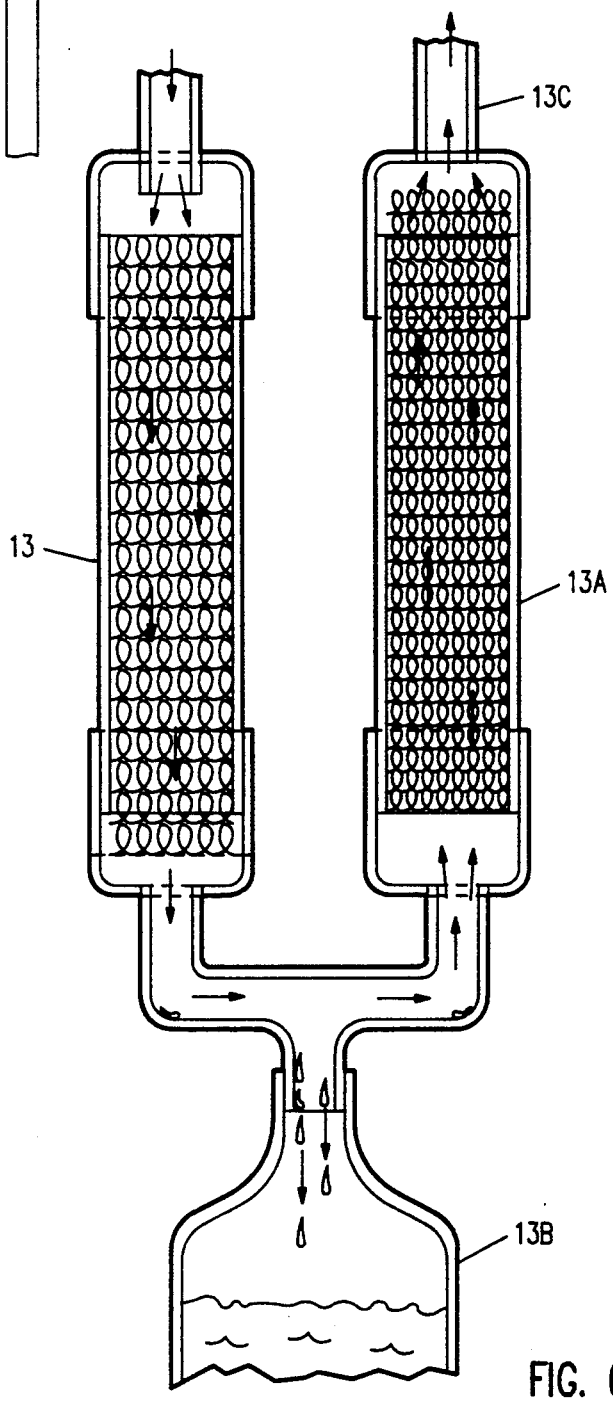

FIG. 4 illustrates an alternative embodiment of the invention. In operation, toxic fumes form in the space between the lid 26 and plating solution 12. The solution fumes and air drawn in from air inlet apertures 25 leave the tank 10 through a drain 8 and move down a primary scrubbing tube 9 that is configured to cut back and forth at 45 degree angles as it drops down to the airtight separation tank 32. The apparatus of FIG. 4 scrubs the toxic fumes and creates a trap to prevent the fumes from backing up the tube 9 into the plating tank 10. As the solution 12 is mixed with the fumes and air enters the separation tank 32, a high pressure area is formed between the solution 12A and the sealed lid 32A of the separation tank 32. This high pressure causes the remaining fumes to move through a secondary scrubber/filter comprising a coarse filter/condenser 33 and a fine filter/condenser 33A which is attached to the separation tank 32. Both filters 33 and 33A are filled with a polypropylene filling. The remaining air and hydrogen are then vented out through a vent tube 33C. Water and plating solution condensed from fine fumes in the filter 33 drop down and are collected in a container 33B to be returned to the solution 12. Inside the separation tank 32, a heater and/or refrigeration unit 30 is positioned for heating or cooling of solution 12A to a desired temperature for plating. As the solution is drained into the separation tank 32, it enters a pump 28 disposed outside the separation tank, and the solution is pumped through a valve back into the plating tank 10. In this way, a closed loop for flow of the plating solution is formed, by draining solution 12 from the plating tank 10 through the drain 8 into the separation tank 32, and in turn pumping the solution 12A from the separation tank 32 through the pump 28 back into the plating tank 10. By virtue of the closed loop fume scrubbing system disclosed herein, a significant reduction in the cost and maintenance of a plating system is realized. The only wear that needs to be monitored is in the pump and the heater. The novel system does not require special ventilation. There is no loss of plating solution and if distilled water only is used, the plating solution will remain in good condition for a very long time. Water is not used for the scrubbing process, so the large amounts of water used in conventional scrubbers is not needed. No heater or refrigeration unit is required within the plating tank itself and there is no need for mixers inside the tank that would take up room. The Venturi and vortex used in the closed loop fume scrubbing system cause the toxic material which is in the form of bubbles to be returned into the plating solution.

What is claimed is:

1. A toxic fume scrubbing apparatus comprising:

a plating tank for containing a plating solution, said tank having anode and cathode electrodes which generate toxic bubbles and toxic fumes during the plating process;

an airtight separation tank coupled to said plating tank in a closed loop configuration;

means for circulating said plating solution between said plating tank and said airtight separation tank within said closed loop;

means connected to said tanks for scrubbing said toxic bubbles to remove said toxic fumes;

a lid having air inlet holes formed therein positioned on the top of said plating tank.

2. An apparatus as in claim 1, wherein said scrubbing means comprises a Venturi tube.

3. An apparatus as in claim 2, including a containment chamber disposed within said plating tank for capturing the scrubbed toxic bubbles and for venting said scrubbed bubbles to said holding tank.

4. An apparatus as in claim 3, wherein said containment chamber encloses said Venturi tube.

5. An apparatus as in claim 3, including an air intake for said Venturi tube.

6. An apparatus as in claim 1, wherein said scrubbing means comprises a Venturi and/or vortex scrubbing device.

7. An apparatus as in claim 1, wherein said separation tank includes a heater for heating the plating solution.

8. An apparatus as in claim 1, wherein said separation tank includes a pump for circulating plating solution between said holding tank and said plating tank.

9. A scrubbing apparatus as in claim 1, wherein said scrubbing means comprises a primary scrubbing tube having sections that cut back and forth at 45 degree angles approximately.

10. A scrubbing apparatus as in claim 1, wherein said scrubbing means comprises a secondary scrubber/filter means attached to said separation tank.

11. A scrubbing apparatus as in claim 10, wherein said secondary scrubber/filter means comprises a coarse filter/condenser and a fine filter/condenser.

12. A scrubbing apparatus as in claim 11, wherein said filters are filled with polypropylene.

13. A scrubbing apparatus as in claim 11, including a container disposed below said scrubber/filter means for collecting water and plating solution for reuse.

* * * * *